US011662190B2

(12) United States Patent
Weidemann

(10) Patent No.: US 11,662,190 B2
(45) Date of Patent: May 30, 2023

(54) BULLETS

(71) Applicant: Hermann Arthur Weidemann, Gilbert, AZ (US)

(72) Inventor: Hermann Arthur Weidemann, Gilbert, AZ (US)

( * ) Notice: Subject to any disclaimer, the term of this patent is extended or adjusted under 35 U.S.C. 154(b) by 0 days.

(21) Appl. No.: 17/517,721

(22) Filed: Nov. 3, 2021

(65) Prior Publication Data

US 2022/0136810 A1 May 5, 2022

Related U.S. Application Data

(60) Provisional application No. 63/109,002, filed on Nov. 3, 2020.

(51) Int. Cl.
*F42B 12/34* (2006.01)
*F42B 10/44* (2006.01)
*F42B 10/46* (2006.01)

(52) U.S. Cl.
CPC ..... *F42B 12/34* (2013.01); *F42B 10/44* (2013.01); *F42B 10/46* (2013.01)

(58) Field of Classification Search
CPC ..... F42B 12/34; F42B 10/44; F42B 10/46
USPC ..... 102/507
See application file for complete search history.

(56) References Cited

U.S. PATENT DOCUMENTS 5,291,833 A * 3/1994 Boual ..... F42B 12/06 102/506
2020/0256654 A1* 8/2020 Burrow ..... C22C 1/0458
2021/0231423 A1* 7/2021 Burczynski ..... F42B 12/78

FOREIGN PATENT DOCUMENTS

CA 2414149 C * 10/2006 ..... F42B 12/34
WO WO-2019126830 A1 * 6/2019 ..... B21K 1/025

* cited by examiner

*Primary Examiner* — Samir Abdosh
(74) *Attorney, Agent, or Firm* — The Roy Gross Law Firm, LLC; Roy Gross

(57) ABSTRACT

The invention relates to a bullet which includes a bullet-shaped body having a forward-facing central cavity with at least one concentric socket formation defining an inverted frusto-conical shoulder and an elongated insert having a longitudinal trailing shaft portion receivable in a mouth of the forward-facing central cavity of reduced diameter. The elongated insert includes an expansion portion being defined by at least one ball-shaped segment extending forward from the trailing shaft portion, of which the expansion portion fits into the concentric socket formation.

20 Claims, 9 Drawing Sheets

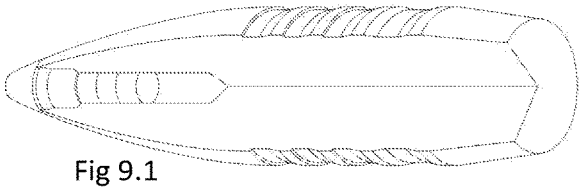
Fig 9.1
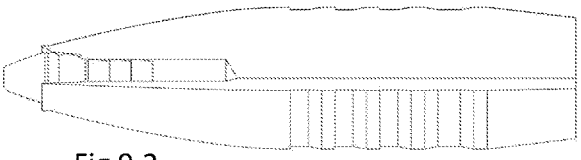
Fig 9.2
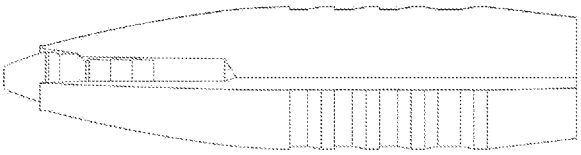
Fig 9.3
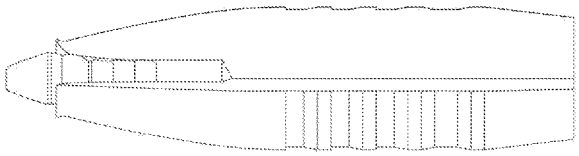
Fig 9.4
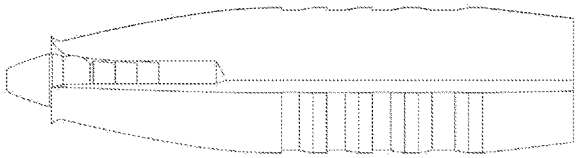
Fig 9.5
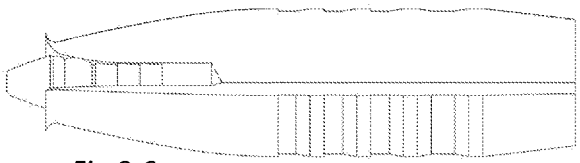
Fig 9.6
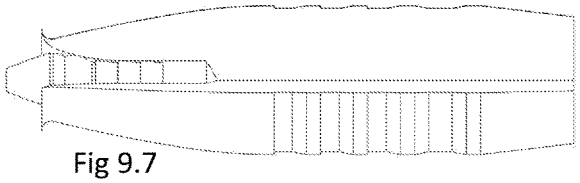
Fig 9.7
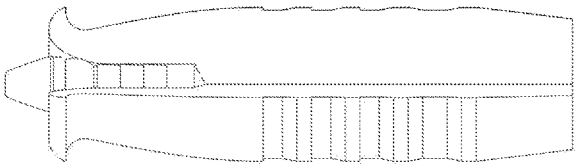
Fig 9.8
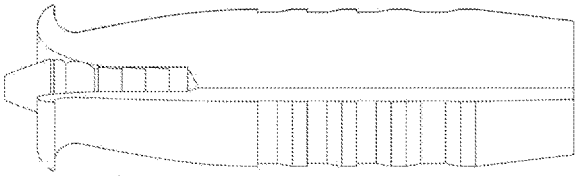
Fig 9.9
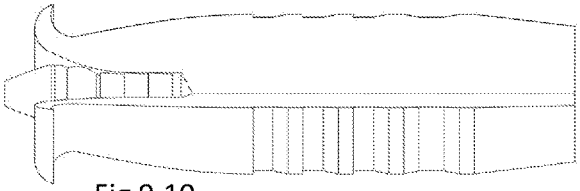
Fig 9.10
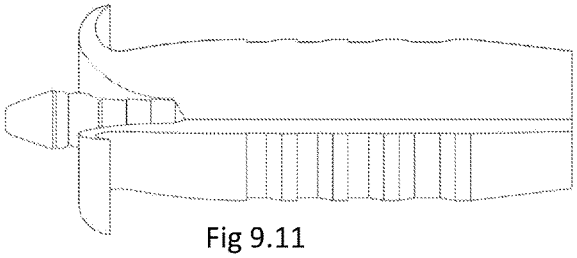
Fig 9.11
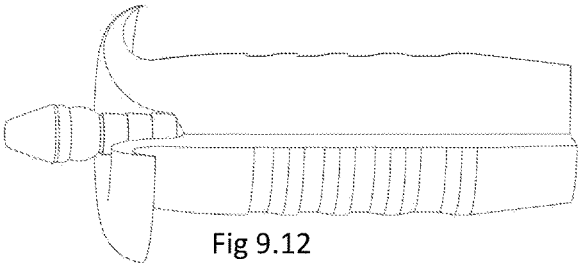
Fig 9.12
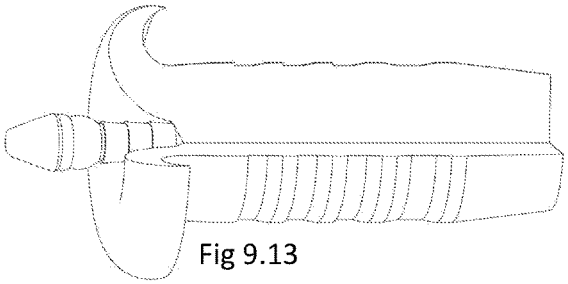
Fig 9.13

BULLETS

FIELD OF THE INVENTION

This invention relates to bullets.

BACKGROUND OF THE INVENTION

In general, hunting bullet designs are directed at maximum transfer of kinetic energy to a target body, in order to prevent over penetration to effect an ethical kill. Bullets are therefore designed to deform upon impact with a target body, which enlarges the cross sectional area, increases the drag coefficient, slows down the projectile and thus transfers maximum kinetic energy within the target body.

One particular bullet design is a high density monolithic aerodynamic shape that comprises a mono-metal cylinder, typically copper or a copper-zinc brass alloy. These mono-metal bullets are further designed to incorporate a filled or open hollow point, which upon impact facilitates deforming the front end of the bullet into the shape of a mushroom.

The mushroom effect of a hollow point bullet can be explained that, upon impact with a sufficiently massive hydrocolloidal or viscoelastic target body, the forward cross-sectional diameter of the bullet is enlarged, the drag coefficient is increased, thereby to create a maximum hydrodynamic resistance to penetration which in turn slows the projectile and thus impart maximum energy from the bullet to the target body.

An important disadvantage of all hollow point bullets is increased aerodynamic drag during flight and the unpredictable and inconsistent manner of deformation of the bullet point upon impact, which may result in fragmentation of the bullet itself, or result in an asymmetric shape, which will alter the intended trajectory inside the target body, thereby missing vital organs.

Another disadvantage of all hollow point bullets is the decreased mass, necessitated by the removal of material to form the hollow cavity. Penetration depth is directly proportional to the momentum of the projectile as can be deduced from the following formula for momentum: Momentum=Mass×Velocity The inventor is aware of conventional mono-metal hollow point bullets and the associated design compromises and has identified a need for a bullet that expands, upon impact, in a predictable, repeatable and stable manner over a wide range of impact velocities.

It is an object of the present invention to provide a bullet with a smooth and continuous opening sequence that would prevent the expander from being lodged in the bullet, thereby rendering it a solid, non-expanding projectile that passes through the target body, wounding the animal and not effecting an ethical kill.

The objective is further to provide the predictable opening sequence for bullets over a wide range of impact velocities.

SUMMARY OF THE INVENTION

According to a first aspect of the invention there is provided a bullet, which includes:

a bullet-shaped body having a forward-facing central cavity with at least one concentric socket formation defining an inverted frusto-conical shoulder;

an elongate insert having a longitudinal trailing shaft portion receivable into a mouth of the forward-facing central cavity of reduced diameter and an expansion portion being defined by at least one ball-shaped segment extending forward from the trailing shaft portion, the expansion portion fitting into the concentric socket formation.

The term ball-shaped refers to an approximation of a portion of a solid sphere including any curved ovoid or parabolic shape.

The forward-facing central cavity depth of the bullet-shaped body may be deeper than the longitudinal trailing shaft portion of the elongate insert.

In one embodiment, the cavity depth may be at least twice the length of the longitudinal trailing shaft portion. In use, the trailing shaft portion will move into the cavity such that the trailing shaft portion will remain inside the cavity until the concentric socket formation is fully expanded.

The elongate insert may be dimensioned such that the end of the trailing shaft falls short of the bottom of the forward-facing central cavity portion when the concentric socket formation is fully expanded.

The longitudinal trailing shaft portion may include inverted rearward facing frusto-conical sections defining barbed rings over at least a portion of the trailing shaft portion. In use, upon movement of the longitudinal trailing shaft portion into the cavity in the bullet body, the barbed rings would retain the elongate insert in the bullet-shaped body as the concentric socket formation is expanded. The barbed rings aid factory assembly, present minimal contact area and thus minimize friction with the encompassing shaft, yet prevent the expander insert from falling out. The forward-facing surfaces of the barbed rings serve as work surfaces against which viscoelastic fluids from the hydrocolloidal target medium can act to facilitate the mushrooming process and allow trapped air in the aft central bullet cavity to escape.

In one embodiment, the forward-facing central cavity may include more than one concentric socket of increased diameter towards the mouth, with each transition to the next concentric socket defining an inverted frusto-conical shoulder. In this embodiment, the expansion portion of the elongate insert may include more than one ball-shaped segment each matched in diameter to its corresponding concentric socket formation.

In use, the ball-shaped segments, each being matched to its corresponding concentric socket diameter, sequentially bear against the inner surface of the socket. Upon impact with the target body, the expander insert starts to move deeper into the forward-facing cavity with the surface of the ball-shaped segments camming the corresponding concentric socket inner surface to a larger diameter. In use, the efficiency with which the central cavity is exposed to high-pressure viscoelastic fluid from the hydrocolloidal target body is of utmost importance. Therefore, a small movement of the expander should dramatically increase the surface area against which dynamic hydraulic pressure can be exerted.

At the shoulder to the next concentric socket of lesser diameter, the next ball-shaped segment impacts the next shoulder, and cams the surface of the frusto-conical shoulder to expand the forward-facing central cavity in a controlled fashion, again dramatically increasing the internal surface area exposed to hydraulic action. The horizontal movement of the ball-shaped segments over the surfaces of the concentric sockets and the frusto-conical shoulders provides a smooth expansion of the forward-facing central cavity by sequentially enlarging a circular line contact in a camming action that requires less force as the ball-shaped section moves linearly, while exposing a conical entrance to high-pressure viscoelastic fluid.

The elongate expander insert is dimensioned such that the longitudinal spacing of consecutive ball-shaped segments of reduced diameter are less than the longitudinal depth of the concentric sockets of lesser diameter, which results in voids being formed between the ball-shaped segments and the concentric socket shoulders. The voids may increase in depth towards the rear of the forward-facing central cavity. On the forward-facing side of the ball-shaped segments these voids present forward facing surface areas against which viscoelastic fluid expunged from the hydrocolloidal target medium may exert force to facilitate longitudinal movement of the elongate expander insert. Viscoelastic fluid from the target body can leak past the ball-shaped segments to lubricate the contact surfaces and thus reduce the friction between the contact surfaces. In use, the first ball-shaped segment will engage the first concentric socket shoulder, then the second ball-shaped segment will engage the second concentric socket shoulder and so forth, thereby to control the flaring of the central cavity from the front towards the rear. The process repeats as the larger ball-shaped segments encounter successive enlarged concentric sockets until the forward motion of the projectile has slowed sufficiently to establish equilibrium between the dynamic pressure and the force required to permanently deform the projectile material. A lower velocity impact will deform only the forward portion, while a higher impact velocity will successively deform all stages of the concentric sockets to maximal mushroom.

In use, as soon as the forward-facing central cavity of the bullet-shaped body starts to flare, the increased cross-sectional area of the flared body encounters increased resistance as it penetrates the target body material, thereby presenting more surface area, which contributes directly to the flaring of the forward-facing central cavity. The function of the elongate expander insert is to facilitate the efficient mechanical opening of the forward-facing bullet cavity, and then act as an intake cone so that hydraulic action by the viscoelastic fluid from the hydrocolloidal target body can complete the mushrooming process.

The elongate expander insert may comprise of a first compound and the bullet-shape body may comprise of a second compound. The first compound may be harder than the second compound, thereby to cause the second compound to be deformed by the first compound.

The elongate expander insert may include a flat meplat for greater expanding power.

The elongate expander insert may include a spitzer ogive with reduced meplat for increased aerodynamic efficiency. The spitzer ogive may be conical with a radius to match the radius of the ogive of the bullet at the transition point, thereby to form a smooth transition between the outer surface of the insert and the outer surface of the bullet.

The elongate expander insert may include a leading portion, which may be flat for greater expanding power or pointed for increased aerodynamic efficiency.

The elongate expander insert, once press-fitted into the cavity, may extend beyond the opening of the bullet, defining a point of impact. The extended point of the insert may be conical with a radius to match the radius of the ogive of the bullet at the transition point, thereby to form a smooth transition between the outer surface of the insert and the outer surface of the bullet.

An outer surface of the bullet-shaped body may include cannelure formations.

The cannelure formations may include any one of forward- and rearward facing frusto-conical shoulders.

The bullet body may include a boat tail.

The bullet may include a plurality of longitudinally extending slits radially spaced on the outer circumference of the bullet body ogive.

The bullet may include one or more circumferential extending bending grooves around the outer circumference of the bullet body ogive.

The invention is now described, by way of non-limiting example, with reference to the accompanying figures:

FIGURE(S)

In the figure(s):

Figure 7:
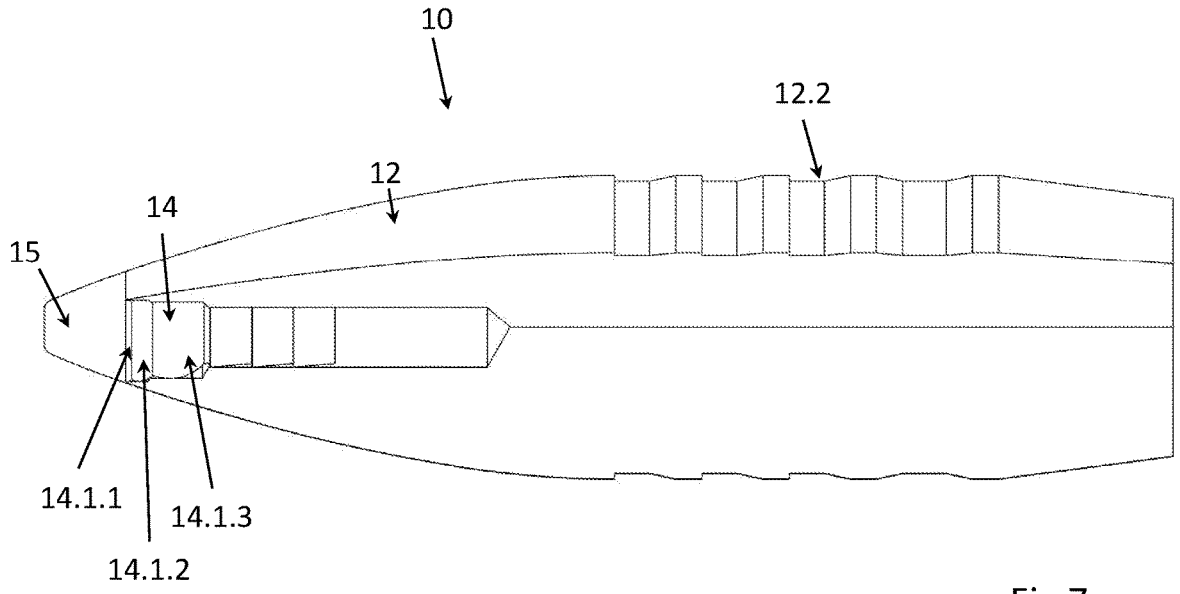
FIG. 7 shows a section of a bullet in accordance with another aspect of the invention with a spitzer, aerodynamic ogive and a reduced meplat.
Figure 8:
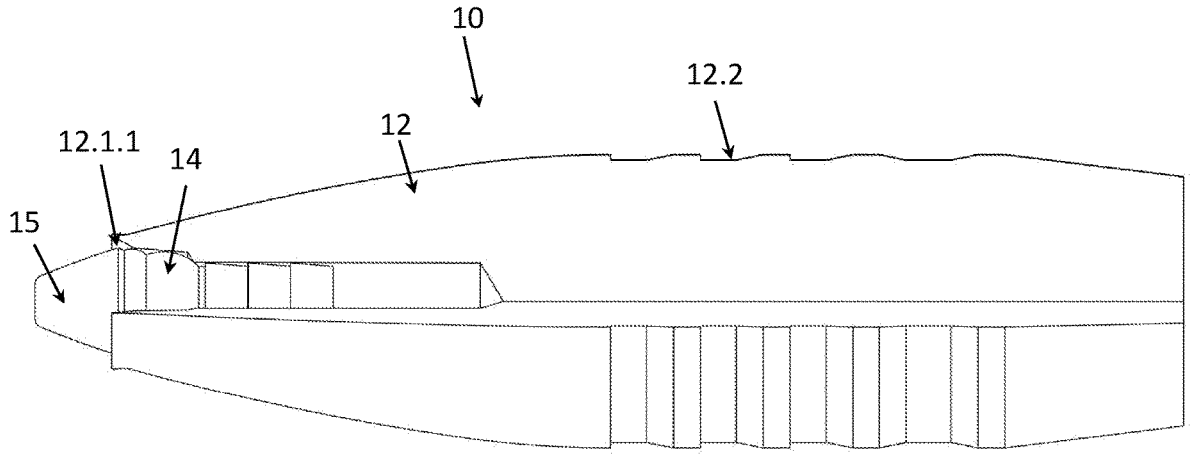
FIG. 8 shows a section of FIG. 7 in the initial stage of deformation.
Figure 10:
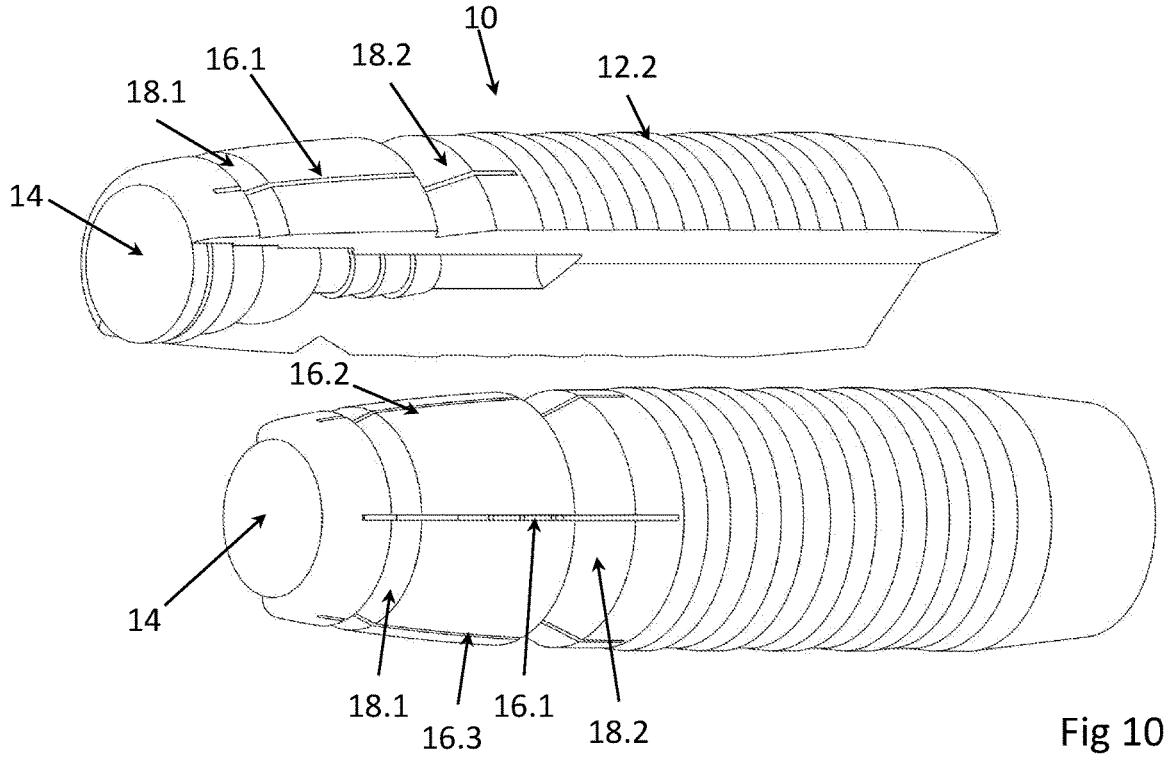
Figure 11:
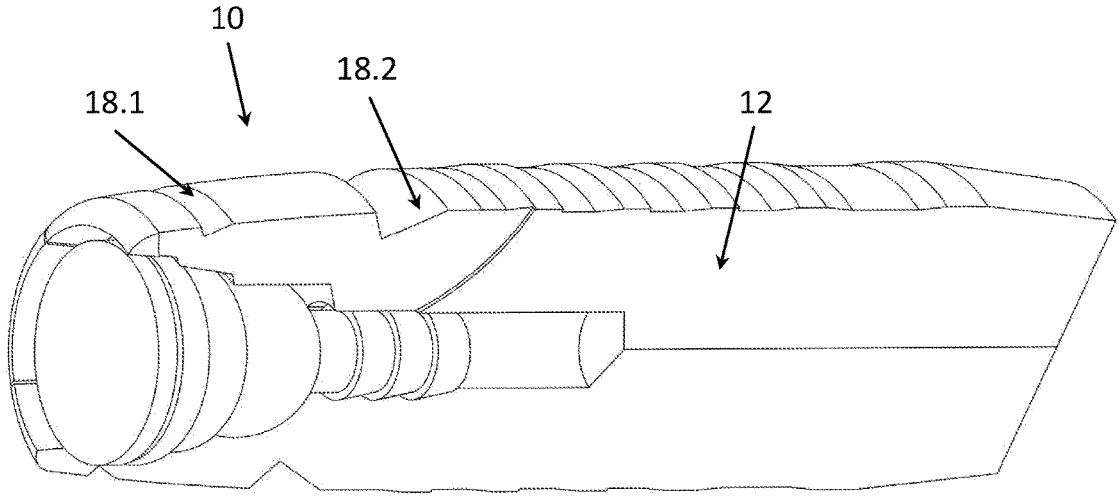
Figure 15:
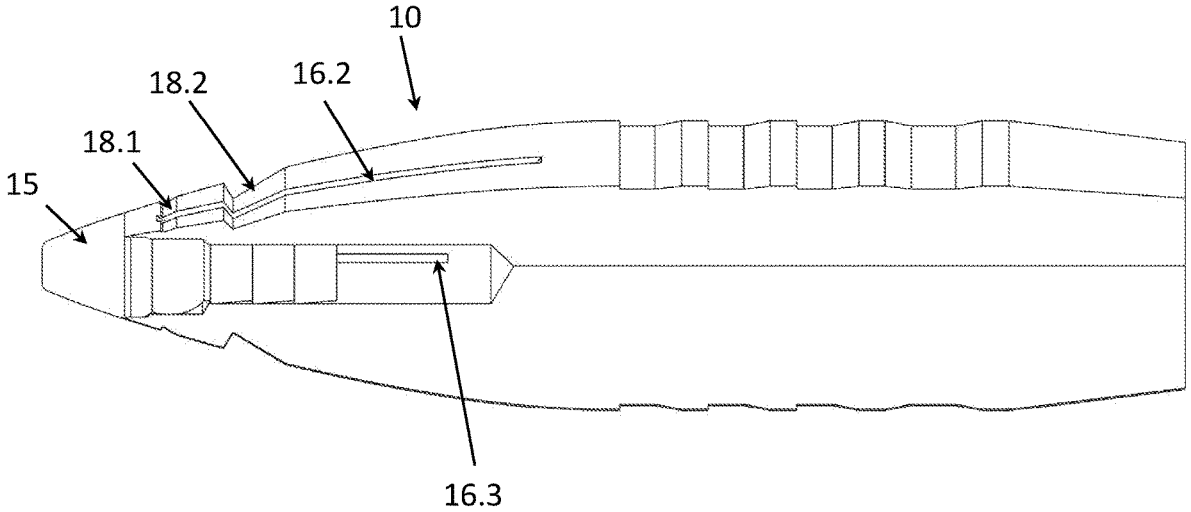
Figure 16:
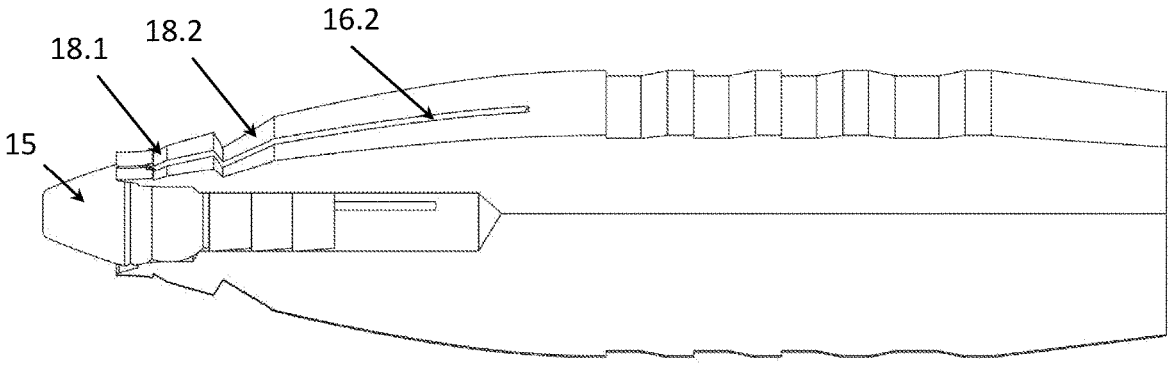
Figure 17:
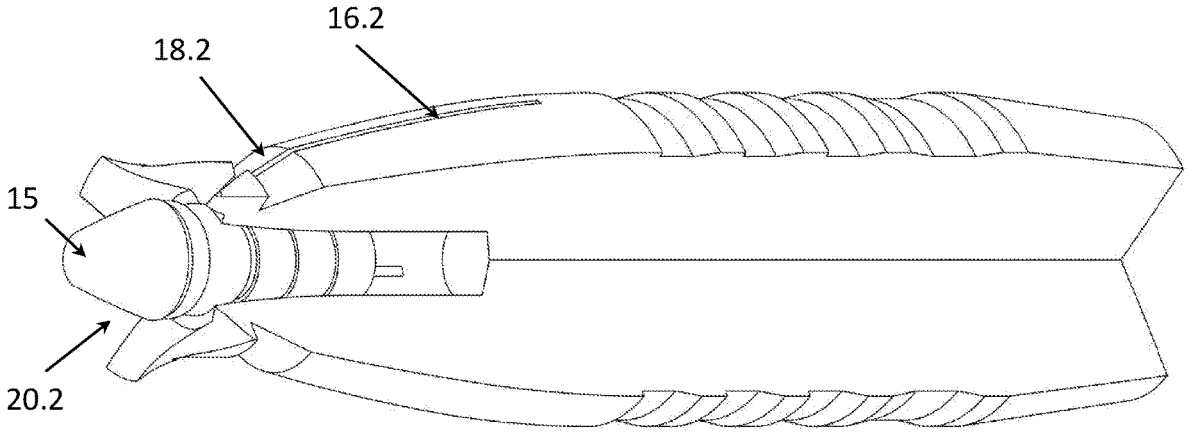
Figure 18:
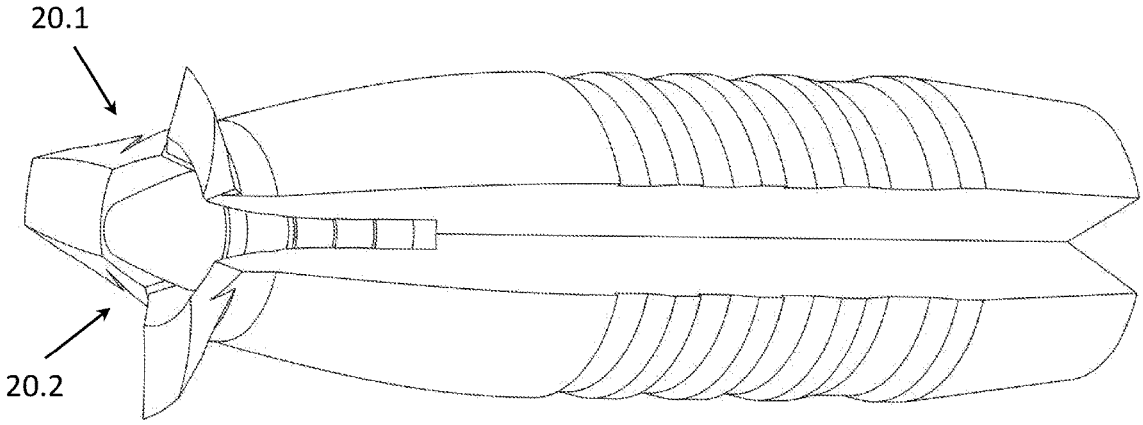

FIGS. 9.1 to 9.13 show a deformation sequence of the bullet of FIGS. 7 and 8, in use;

FIG. 10 shows a bullet in accordance with another aspect of the invention;

FIGS. 11 to 14 shows a deformation sequence of the bullet of FIG. 10, in use;

FIG. 15 shows a bullet in accordance with another aspect of the invention; and FIGS. 16 to 18 shows a deformation sequence of the bullet of FIG. 15, in use.

In the figures, like reference numerals denote like parts of the invention unless otherwise indicated. In some figures reference numerals have been omitted for clarity.

EMBODIMENT OF THE INVENTION

In one embodiment, shown in FIGS. 1 to 6, the bullet has a blunt meplat, which maximizes the frontal area of the expander ($A_e$) and facilitates optimal expansion, but at the expense of long-range aerodynamics.

In another embodiment, shown in FIGS. 7 to 9.13 the bullet has a spitzer, aerodynamic ogive (15) and much reduced meplat (front tip of the elongate insert 14), which aids long-range ballistics, but presents a challenge to efficient expansion. In this embodiment the first cam FIG. 7 (14.1.1) is smaller to aid expansion as soon as the spitzer meplat makes contact with a target.

In another embodiment, shown in FIGS. 10 to 14, the bullet has a blunt meplat like the embodiment of FIGS. 1 to 6, but with three or more fine radially spaced longitudinal slits and two circumferential bending grooves (18.1) and (18.2). The purpose of this embodiment is to facilitate controlled expansion at subsonic impact velocities. The expander produces a force upon impact that shears the slits forward, through to the meplat, upon which the much lower subsonic dynamic pressure (qs) will bend back the thin tips, which will then use the law of leverage to complete the expansion as shown in FIGS. 11 to 14.

In another embodiment, shown in FIGS. 15 to 18, the bullet of FIGS. 10-14 is shown but with a spitzer, aerodynamic ogive and much reduced meplat, similar to the bullet of FIGS. 7 to 9.13, but with three or more radially spaced longitudinal slits (16.2) and two circumferential bending grooves (18.1) and 18.2).

Figure 1:
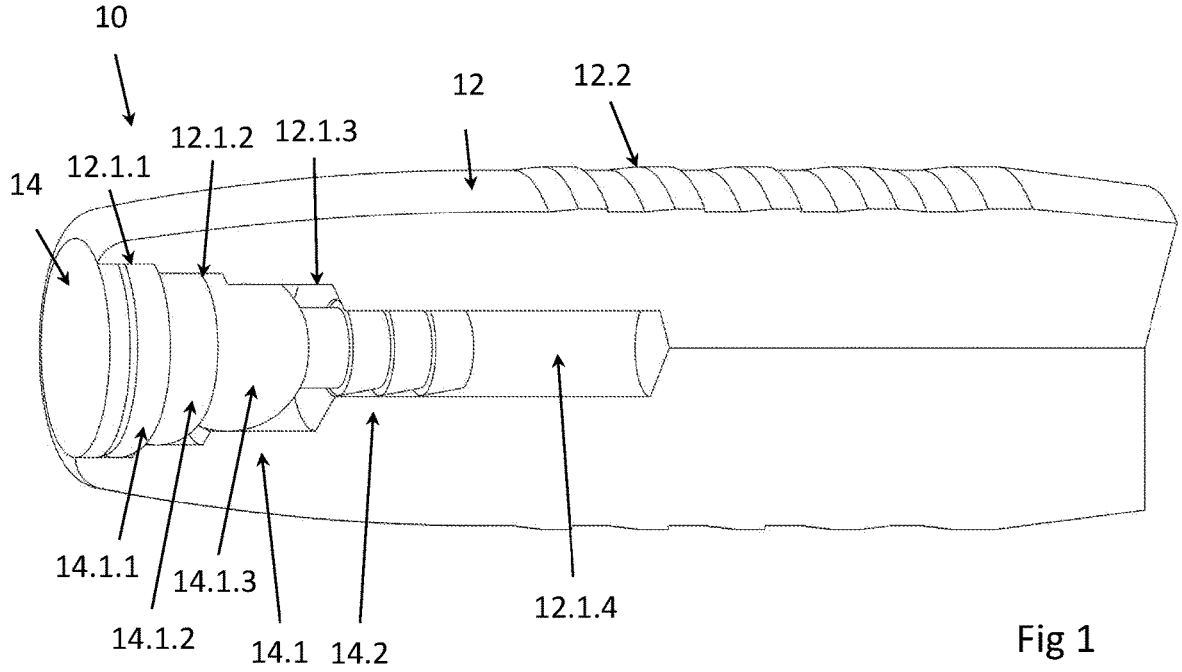
FIG. 1 shows a bullet in accordance with one aspect of the invention with a blunt meplat.
Figure 2:
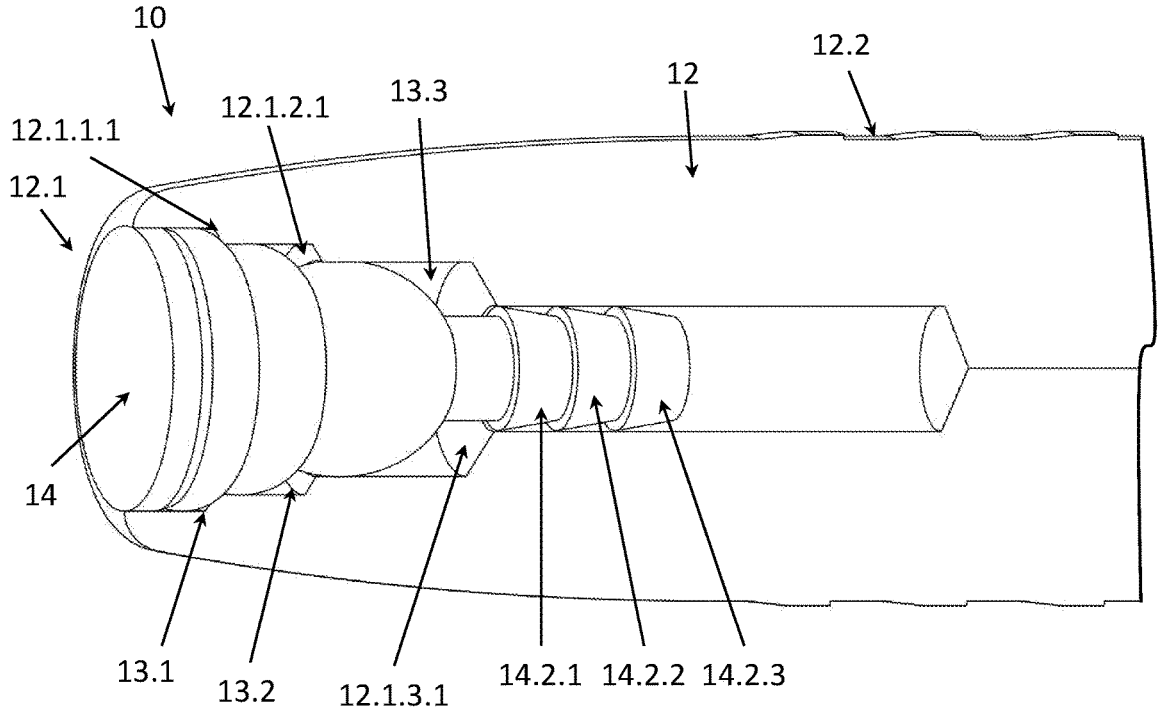
FIG. 2 shows a detailed front section of the bullet of FIG. 1.
Figure 3:
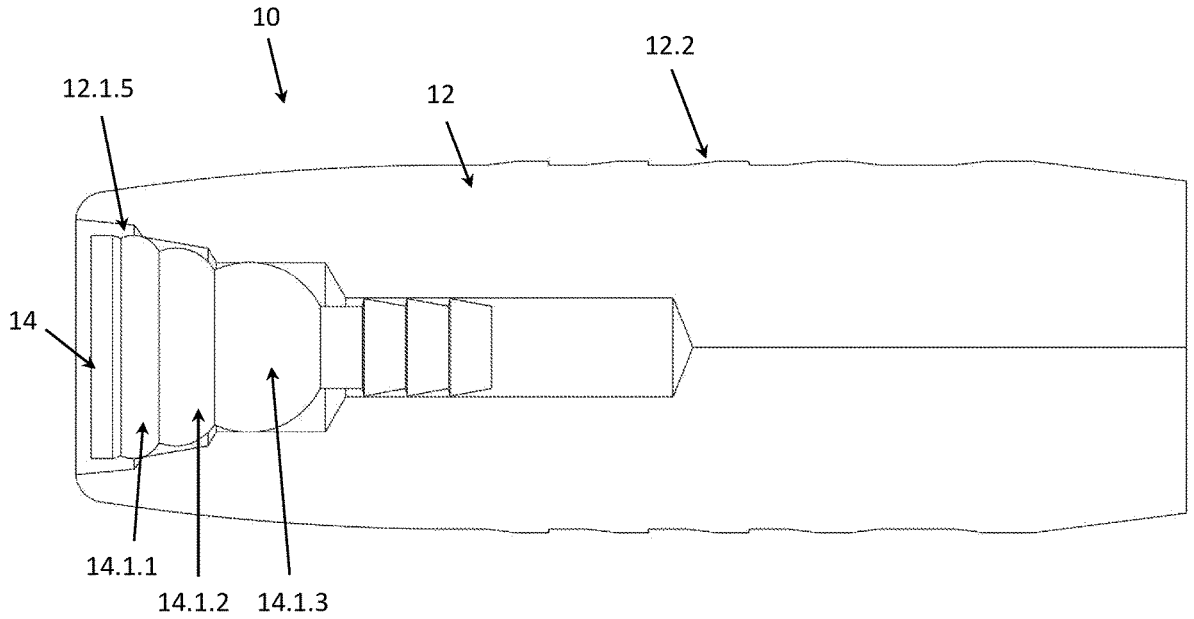
FIGS. 3 to 6 show the bullet of FIG. 1 in use with the forward facing cavity sequentially being expanded.
Figure 4:
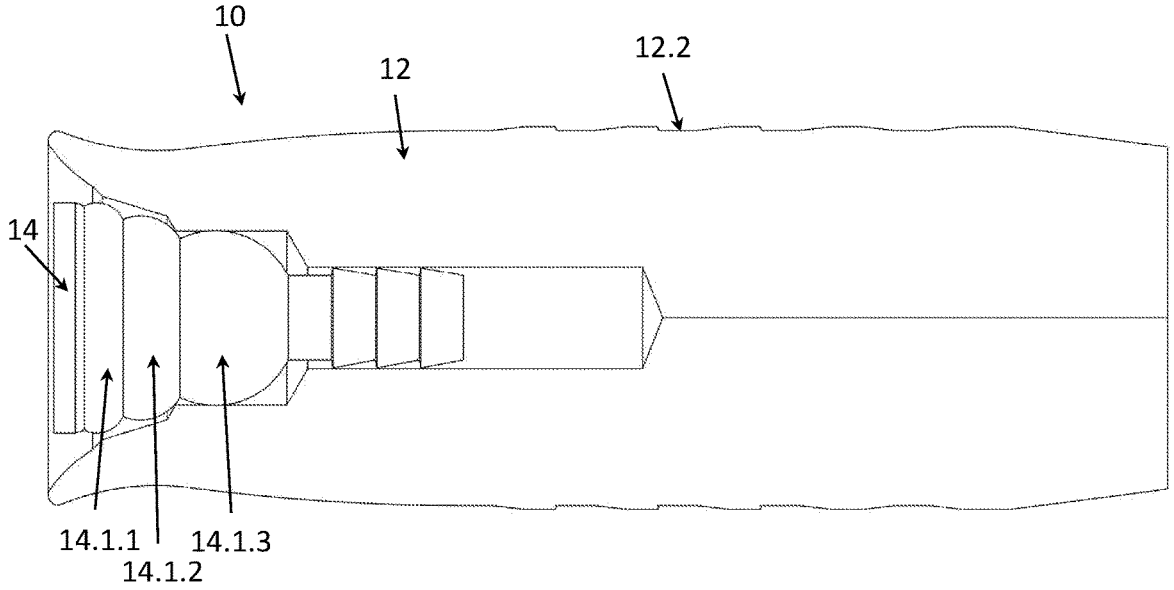
Figure 5:
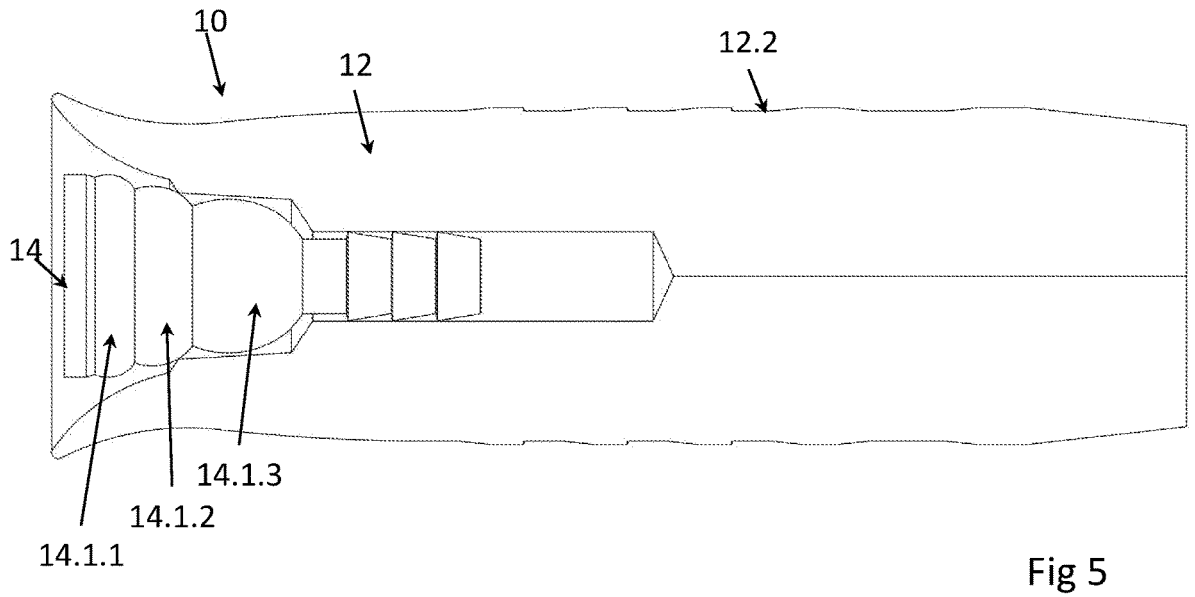
Figure 6:
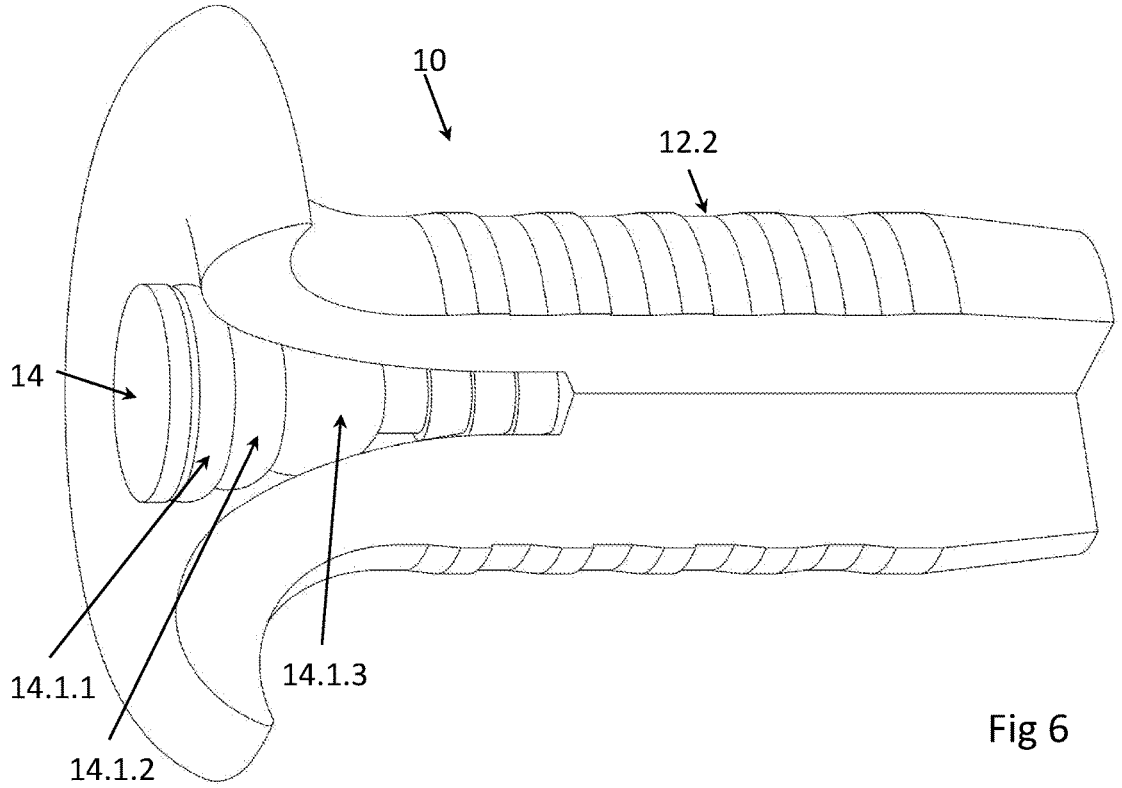

As can be seen in FIGS. 1 and 2 a bullet (10) includes a bullet-shaped body (12) having a forward-facing central cavity (12.1) with four concentric socket formations (12.1.1-12.1.4) of which three concentric socket formations (12.1.1-12.1.3) define inverted frusto-conical shoulders (12.1.1.1-12.1.3.1). For clarity some numerals were omitted on some of the drawings.

The bullet (10) further includes an elongate insert (14) having a longitudinal trailing shaft portion (14.2) receivable into a mouth of the forward-facing central cavity (12.1) and an expansion portion (14.1) being defined by three ball-shaped segments (14.1.1-14.1.3) extending forward from the trailing shaft portion (14.2).

As can be seen in FIGS. 1 and 2, the elongate expander insert (14) fits into the forward-facing central cavity (12.1) with the longitudinal trailing shaft portion (14.2) fitting into the socket 12.1.4 and the expansion portion (14.1), with its three ball-shaped segments (14.1.1-14.1.3) fitting into the concentric socket formations (12.1.1-12.1.3), respectively.

As can be seen in FIGS. 1 and 2, the depth of the socket (12.1.4) of the bullet-shaped body (12) is deeper than the longitudinal trailing shaft portion (14.2) of the elongate expander insert (14). In this example, the socket depth (12.1.4) is at least twice the length of the longitudinal trailing shaft portion (14.2).

The longitudinal trailing shaft portion (14.2) includes inverted rearward facing frusto-conical sections defining barbed rings (14.2.1-14.2.3) over at least a portion of the trailing shaft portion (14.2).

The ball-shaped segments (14.1.1-14.1.3), are matched to their corresponding concentric socket (12.1.1-12.1.3) diameters and press against the inner surfaces of the concentric sockets (12.1.1-12.1.3).

As can be seen in FIGS. 3 to 6, upon impact with the target body, the insert (14) starts to move deeper into the forward-facing cavity (12.1) with the surfaces of the ball-shaped segments (14.1.1-14.1.3) moving aft, contacting the frusto-conical shoulder formations (12.1.1.1-12.1.3.1) and thereby expanding the successive concentric sockets (12.1.1-12.1.4) through a camming action.

As can be seen in FIGS. 1 and 2 the elongate expander insert (14) is dimensioned such that the longitudinal spacing of consecutive ball-shaped segments (14.1.1-14.1.3) of reduced diameter are less than the longitudinal depth of the concentric sockets (12.1.1-12.1.3) of stepped diameter, which results in voids (13.1 to 13.3) being formed between the ball-shaped segments (14.1.1-14.1.3) and the concentric socket shoulders (12.1.1.1-12.1.3.1). As can be seen in FIG. 2, the voids increase in depth towards the rear of the forward-facing central cavity (12.1).

In use, as can be seen in FIGS. 1 to 6, the ball-shaped segment (14.1.1) will interfere first with the shoulder (12.1.1.1) and exert a radial camming force from the ball-shaped segment (14.1.1), forcing the socket (12.1.1) and socket (12.1.2) open. As the insert (14) moves deeper into the forward-facing cavity (12.1), the ball-shaped segment (14.1.2) will interfere then with the shoulder (12.1.2.1) and exert a further radial camming force from the ball-shaped segment (14.1.2), forcing the socket (12.1.3) open. Lastly as the insert (14) moves even deeper into the forward-facing cavity (12.1), the ball-shaped segment (14.1.3) will interfere then with the shoulder (12.1.3.1) and exert a further radial camming force, forcing cavity (12.1.4) to open. Further movement of insert (14) will cause contact from successive ball-shaped segments (14.1.1-14.1.3) to make contact with shoulders (12.1.2.1-12.1.3.1) and further enlarge sockets (12.1.1-12.1.4).

In the embodiment, shown in FIGS. 7 to 9.13 the bullet shares the same internal configuration as the embodiment shown in FIGS. 1 to 6, except that the bullet has an aerodynamic ogive spitzer (15) at the tip of the insert (14), and much reduced meplat.

The ball-shaped segment 14.1.1 and its associated socket 12.1.1 is smaller to aid expansion as soon as the spitzer makes contact with a target as can be seen in FIG. 8, which shows the initial stage of opening of the first socket 12.1.1 by the segment 14.1.1.

Following on from FIG. 8, the complete opening sequence of the FIG. 7 bullet (10) is shown in FIGS. 9.1 to 9.13.

The embodiment, shown in FIGS. 10 to 14, is similar to the embodiment of FIGS. 1 to 6 and for clarity the same reference numerals have been omitted with only the changes being described.

On the outside of the bullet body longitudinally extending slits (16.1-16.4) are provided spaced radially at equal distances on the outer circumference of the bullet body (12). The number of slits is commensurate with the amount of pre-weakening of the bullet structure required for dependable controlled expansion.

Furthermore two circumferential bending grooves (18.1 and 18.2) are provided around the outer circumference of the bullet body (12).

In use, as can be seen in the opening sequence of FIGS. 11 to 14, as the bullet impacts the target, the insert (14) starts to move aft into the central cavity (12.1), but the opening of the cavity is aided by the longitudinal slits (16.1 to 16.4) and bending grooves (18.1) and (18.2).

Figure 12:
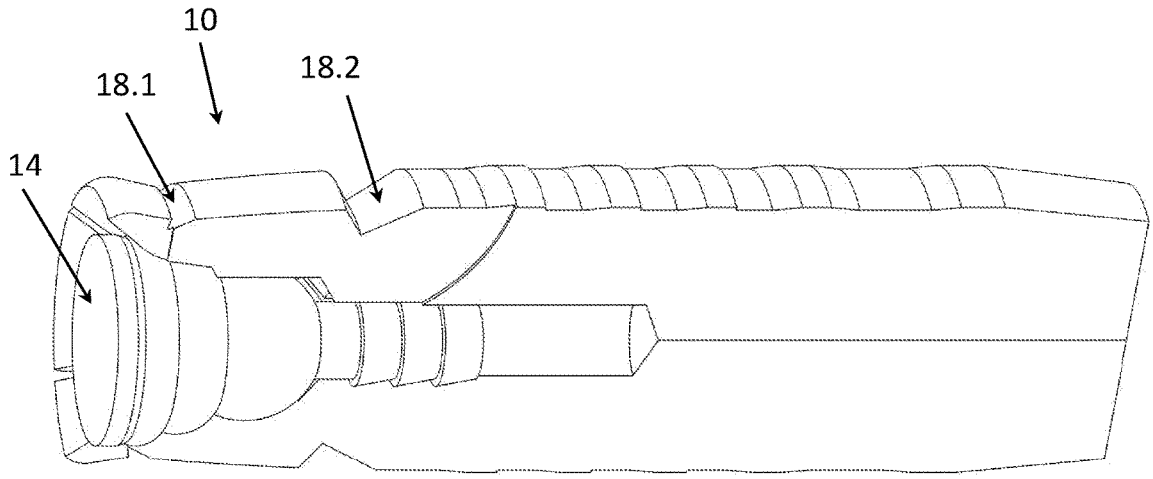
Figure 13:
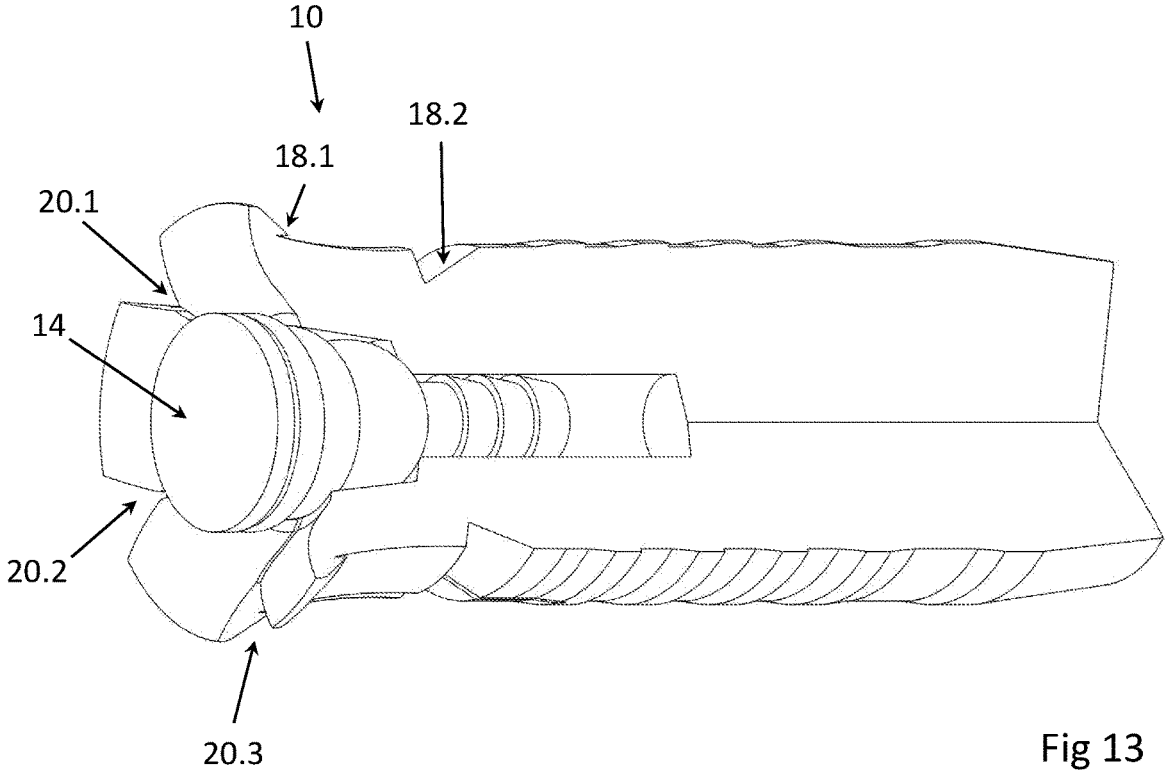

As can be seen in FIG. 12, as the insert (14) moves into the central cavity (12.1), the circumferential bending groove (18.1), being a zone of weakness in the bullet body (12) starts to bend to facilitate opening of the central cavity (12.1). As can be seen in FIG. 13, the bending groove (18.1) is almost completely closed and the bending groove (18.2) is starting to close. Initial aft movement of insert (14) tears slits (16.1 to 16.4) forward towards the meplat face. These tears (20.1 to 20.4) form along the longitudinal slits (16.1 to 16.4) facilitating the bending outward of individual petals, presenting segmented forward facing surface area, similar to the mushroom in FIGS. 3 through 6.

Figure 14:
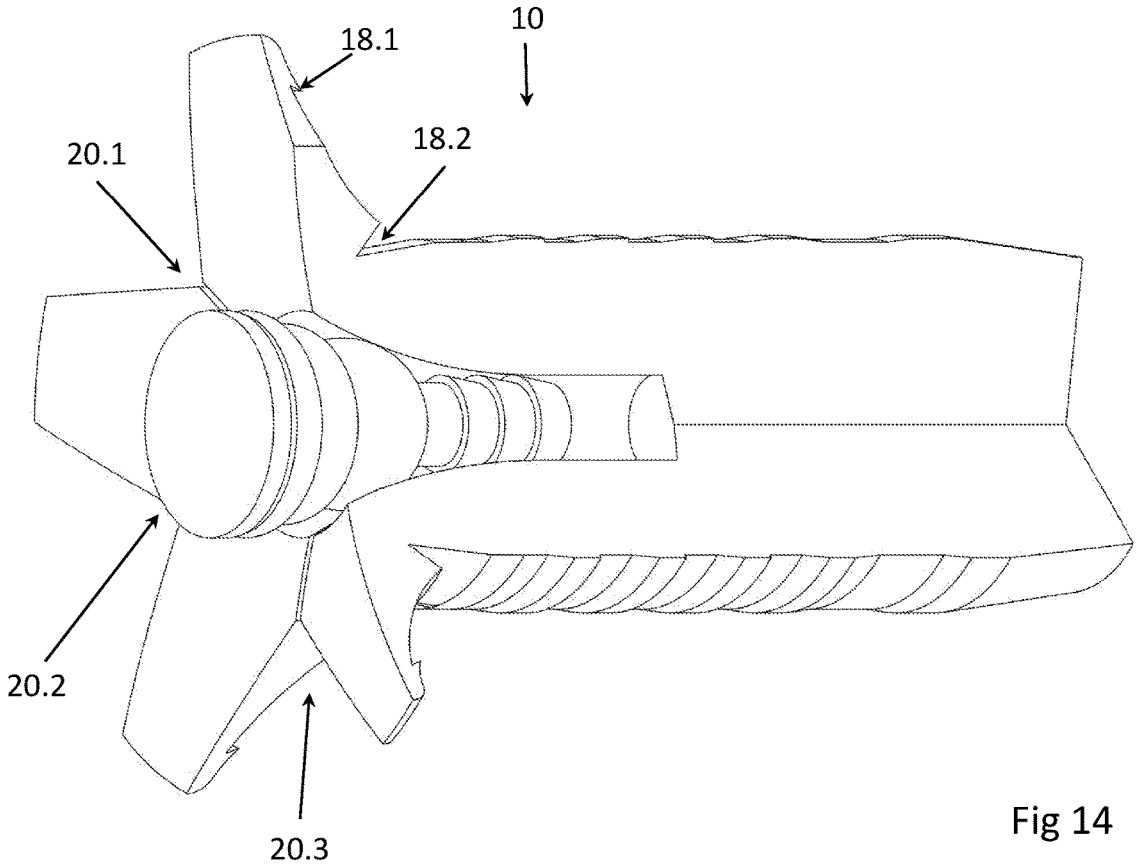

In FIG. 14 the expansion of the bullet body (12) is almost complete with the bending groove (18.1) being completely closed and the bending groove (18.2) also mostly closed. The opening tears (20.1 to 20.4) are almost completely open.

The embodiment shown in FIGS. 10 to 14 is of particular use in lower speed bullets where opening at the low speed impact is aided by the longitudinally extending slits (16.1-16.4) and the circumferential extending bending grooves (18.1 and 18.2).

The purpose of this embodiment is to facilitate controlled expansion at subsonic impact velocities. The expander produces a force upon impact that shears the longitudinally extending slits (16.1-16.4) forward to the meplat, upon which the much lower subsonic dynamic pressure (qs) will bend back the thin tips, which will then use the law of leverage to complete the expansion as shown in FIGS. 11 to 14.

In another embodiment, shown in FIGS. 15 to 18, the aerodynamic spitzer bullet of FIGS. 10 to 14 is shown but with a much reduced meplat, similar to the bullet of FIGS. 7 to 9.13

In use, the dynamic pressure (q) of a projectile at impact is $q=\frac{1}{2}\rho v^2$ with $\rho$ being the density of the viscoelastic or hydrocolloidal target medium and v being the impact velocity. The static pressure is negligible and thus omitted. Impact dynamic pressure ($q_0$) multiplied by the forward-facing cross-sectional surface area ($A_e$) of the expander insert (14) yields the initial force ($F_i$) which forces the expander insert (14) into the bullet cavity (12.1) to deform the bullet. $F_i=q_0\times A_e$. The initial longitudinal impact force needs to be translated perpendicular to the axis of travel to effect expansion. The ductile monolithic bullet material, typically copper, needs to be stretched past its yield point to effect plastic deformation.

By utilizing a cam action, the movement of the expander into the bullet cavity (12.1) remains linear, while exerting an ever-increasing outward force vector upon the ductile bullet material. The cavity created by the expander's linear movement exposes a slightly conical internal surface area ($A_{cone}$) in the forward bullet cavity. The slightly reduced dynamic pressure ($q_1$) is directly available to exert an additional radial force ($F_r$) outward on the inside wall of the resulting conical bullet cavity to further facilitate plastic deformation. $F_r=q_1\times A_{cone}$. It is the claim of this application that the cam-shape of the expander is the most efficient method to facilitate the controlled plastic mushroom deformation of the mono-metal bullet, because it instantly allows high-pressure viscoelastic fluid into successively enlarged conical entry cavities, before the impact velocity ($v_0$) and the initial dynamic pressure ($q_0$) is substantially reduced.

Once the bullet material has been sufficiently deformed radially outward, the internal conical cavity will have been swaged perpendicular to the direction of travel. This partially mushroomed circular surface ($A_m$) presents another surface area against which the hydraulic force of the further reduced dynamic pressure ($q_2$) can exert a deforming and decelerating force ($F_d$). $F_d=q_2\times A_m$. Once equilibrium has been reached and no further deformation of the bullet material can occur, this formula, with a continually decaying velocity component, in conjunction with a shear component of the wound cavity material, dictates the deceleration of the projectile within the target medium. The shear component is directly related to the diameter of the expanded mushroom cross-section.

With the above in mind, referring back to FIGS. 9.1 to 9.13, the opening sequence of the forward-facing cavity (12.1) is shown in FIGS. 9.1 to 9.13. This opening sequence takes place under the influence of the two forces described above. The first force is the expansion force being exerted by the expander insert (14) moving deeper into the forward-facing cavity (12.1) under influence of the expander insert's (14) front face engaging the bulk of the target body. The second force is the drag force of the forward-facing conical cavity engaging the hydraulic action of the viscoelastic fluid from the hydrocolloidal target body. Once the forward-facing cavity (12.1) mouth starts to flare, the cross-sectional area of the flared forward-facing cavity (12.1) causes increased resistance as it penetrates the target body material, thereby presenting more surface area, which contributes directly to additional flaring of the forward-facing central cavity (12.1).

As the insert (14) moves deeper into the forward-facing cavity (12.1), the expander insert (14) is guided into the socket (12.1.4) and held in place by the barbed rings (14.2.1-14.2.3) on the trailing shaft portion (14.2). Forward-facing surface areas on the ball-shaped formations (14.1.1-14.1.3) engaging viscoelastic fluid from the target body contribute to lubrication between the insert (14) and the walls of the forward-facing cavity (12.1), thereby reducing friction and facilitating rearward propulsion of the insert (14) by hydraulic forces.

As set out above, it is an object of the invention that the forward-facing cavity (12.1) open in a controlled fashion. Importantly, the camming movement of the ball-shaped segments (14.1.1-14.1.3) over the concentric socket shoulders (12.1.1.1-12.1.3.1) provides a smooth expansion of the forward-facing central cavity. In use, the circular point contact between ball-shaped segments (14.1.1-14.1.3) and successive smaller sockets (12.1.2-12.1.4) reduces friction, controls the let-off in the camming force and allows lubrication by viscoelastic fluids from the target body.

In this example, the insert (14) is of a harder compound than the bullet-shaped body (12), so that the bullet-shaped body (12) can be deformed by the elongate expander insert (14). A softer material of the bullet-shaped body (12) allows the body (12) to be more malleable than the insert (14).

As can be seen in FIGS. 1 to 18, the outer surface of the bullet-shaped body includes cannelure formations (12.2). The cannelure formations (12.2) have rearward and forward facing frusto-conical shoulders the purpose of which is to seal off propellant gasses between the bullet and the rifle barrel during firing.

The inventor believes that the invention provides a new expandable hunting bullet with a smooth and continuous opening sequence, over a wide range of impact velocities, due to the camming action of the ball-shaped expander sections that would prevent the insert (14) from being lodged in the bullet (10) and thus rendering it a solid, non-expandable projectile.

The invention claimed is:

1. A bullet, which includes:

a bullet-shaped body having a forward-facing central cavity with at least one concentric socket formation defining an inverted frusto-conical shoulder;

an elongate insert having a longitudinal trailing shaft portion receivable into a mouth of the forward-facing central cavity and an expansion portion being defined by at least one ball-shaped segment extending forward from the trailing shaft portion, the expansion portion fitting into the concentric socket formation.

2. A bullet as claimed in claim 1, in which a cavity depth of the bullet-shaped body is deeper than the longitudinal trailing shaft portion of the elongate insert.

3. A bullet as claimed in claim 2, in which the cavity depth is at least twice the length of the longitudinal trailing shaft portion.

4. A bullet as claimed in claim 1, in which the longitudinal trailing shaft portion includes inverted rearward facing frusto-conical sections defining barbed rings over at least a portion of the trailing shaft portion.

5. A bullet as claimed in claim 1, in which the forward-facing central cavity includes more than one concentric socket of increased diameter towards the mouth, with each transition to the next concentric socket defining an inverted frusto-conical shoulder.

6. A bullet as claimed in claim 5, in which the expansion portion of the elongate insert includes more than one ball-shaped segment each matched in diameter to its corresponding concentric socket formation.

7. A bullet as claimed in claim 6, in which the ball-shaped segments are each matched to their corresponding concentric socket diameter, to bear against the inner surface of the socket.

8. A bullet as claimed in claim 7, in which the elongate insert is dimensioned such that the longitudinal spacing of consecutive ball-shaped segments of reduced diameter are less than the longitudinal depth of the concentric sockets of lesser diameter, which results in annular voids being formed between the ball-shaped segments and the concentric socket shoulders.

9. A bullet as claimed in claim 8, in which the annular voids increase in depth towards the rear of the forward-facing central cavity.

10. A bullet as claimed in claim 9, which, in use, as soon as the forward-facing central cavity of the bullet-shaped body starts to flare, the increased cross-sectional area of the flared body encounters increased resistance as it penetrates the target body material, thereby presenting more surface area, which contributes directly to the flaring of the forward-facing central cavity.

11. A bullet as claimed in claim 1, in which the elongate insert comprises a first compound and the bullet-shape body comprises a second compound.

12. A bullet as claimed in claim 11, in which the first compound is harder than the second compound, thereby to cause the second compound to be deformed by the first compound.

13. A bullet as claimed in claim 1, in which the elongate insert includes a flat meplat for greater expanding power.

14. A bullet as claimed in claim 1, in which the elongate insert includes a spitzer ogive with reduced meplat for increased aerodynamic efficiency.

15. A bullet as claimed in claim 14, in which an extended point of the insert is conical with a radius to match the radius of the ogive of the bullet at the transition point, thereby to form a smooth transition between an outer surface of the insert and an outer surface of the bullet.

16. A bullet as claimed in claim 1, in which an outer surface of the bullet-shaped body includes cannelure formations.

17. A bullet as claimed in claim 16, in which the cannelure formations include any one of forward facing frusto-conical shoulders and rearward facing frusto-conical shoulders.

18. A bullet as claimed in claim 1, in which the bullet body includes a boat tail.

19. A bullet as claimed in claim 1, which includes a plurality of longitudinally extending slits radially spaced on an outer circumference of a bullet body ogive.

20. A bullet as claimed in claim 1, which includes one or more circumferential bending grooves around an outer circumference of a bullet body ogive.

* * * * *